US005808258A

United States Patent [19]

Luzzi

[11] Patent Number: 5,808,258

[45] Date of Patent: Sep. 15, 1998

[54] ENCAPSULATED HIGH VOLTAGE VACUUM SWITCHES

[75] Inventor: Glenn J. Luzzi, Mt. Bethel, Pa.

[73] Assignee: Amerace Corporation, Hackettstown, N.J.

[21] Appl. No.: 578,038

[22] Filed: Dec. 26, 1995

[51] Int. Cl.[6] ..... H01H 33/66; H01H 33/53

[52] U.S. Cl. ..... 218/136; 218/138; 218/139; 218/155; 218/140

[58] Field of Search ..... 218/89, 138–140, 218/153, 154, 155–158, 302.1–302.3, 134–137

[56] References Cited

U.S. PATENT DOCUMENTS

| | | | |
|---|---|---|---|
| 2,744,984 | 5/1956 | Hults | 200/302.1 X |
| 2,794,101 | 5/1957 | Jennings | 218/136 |
| 2,853,584 | 9/1958 | Upton, Jr. | 218/89 |
| 2,870,298 | 1/1959 | Schwager | 218/138 |
| 2,995,639 | 8/1961 | Panerai et al. | 200/302.1 |
| 3,244,015 | 4/1966 | Parris, Jr. | 74/107 |
| 3,471,669 | 10/1969 | Curtis | 200/302.1 |
| 3,812,314 | 5/1974 | Nonken | 218/138 |
| 3,941,957 | 3/1976 | Tilman | 200/82 R |
| 3,955,167 | 5/1976 | Kumbera | 218/138 X |
| 3,956,721 | 5/1976 | Link | 218/139 X |
| 4,124,790 | 11/1978 | Kumbera et al. | 218/138 X |
| 4,150,270 | 4/1979 | Zunick | 218/138 |
| 4,215,253 | 7/1980 | Tilman | 200/82 R |
| 4,230,922 | 10/1980 | Habecker | 200/302.2 |
| 4,568,804 | 2/1986 | Luehring | 218/138 |
| 4,709,126 | 11/1987 | Miller et al. | 200/83 P |
| 4,877,930 | 10/1989 | Fukuma | 200/302.2 |
| 4,894,497 | 1/1990 | Lycan | 200/83 R |
| 5,216,213 | 6/1993 | Sato | 200/302.1 X |

*Primary Examiner*—J. R. Scott
*Attorney, Agent, or Firm*—Lerner David Littenberg Krumholz & Mentlik

[57] ABSTRACT

An encapsulated high voltage switch has an elastomeric housing made of a first high dielectric strength resilient material such as EPDM. A generally tubular reinforcing element is formed or press fitted in intimate contact with the first elastomeric material. A vacuum contact assembly having a fragile ceramic vacuum bottle is disposed inside the reinforcing element, and a filler material different from the first material is disposed between the outer wall of the sub-atmospheric bottle for the coacting contacts in the switch assembly and the inner wall of the reinforcing element. A trip mechanism extends from the exterior into the elastomeric housing and is connected through a lost motion linking mechanism with the coacting contacts to move the contacts from closed to open position and vice versa. Additionally, a method is described for encapsulating the high voltage switch and to safeguard the sub-atmospheric switch assembly in assembled position.

29 Claims, 5 Drawing Sheets

ENCAPSULATED HIGH VOLTAGE VACUUM SWITCHES

This invention relates generally to encapsulated switches used in electric power systems.

BACKGROUND OF THE INVENTION

High voltage switch assemblies with sub-atmospheric or vacuum type circuit interrupters for electric power circuits and systems are well known in the art, such as is shown in U.S. Pat. Nos. 4,568,804; 3,955,167 and 3,471,669. Encapsulated vacuum type switches or circuit breakers are also known, as is shown in U.S. Pat. Nos. 3,812,314, and 2,870,298.

In such switch assemblies and circuit breakers, a pair of coacting contacts, one fixed and the other movable, are provided for controlling and interrupting current flow. The contacts are provided in a controlled atmosphere contact assembly which also includes a relatively fragile glass or ceramic housing, commonly referred to as a "bottle". The contacts are housed within the bottle. A metal bellows is typically provided on one end of the bottle, and the movable contact is linked to the inside of the bellows. An operating rod attached to the outside of the bellows can be moved so as to move the movable contact inside the bottle. The interior of the bottle is maintained under a controlled atmosphere, such as air or another gas under a low subatmospheric pressure, to protect the contacts from damage caused by arcing when the contacts are opened and closed. The glass or ceramic wall of the bottle provides a permeation-resistant enclosure which maintains the controlled atmosphere for the life of the device. While efforts have been made as is shown in the above mentioned patents to protect and reinforce such contact assemblies with solid dielectric materials surrounding the bottles, there are considerable needs for further improvements.

In particular, there is a significant, unmet need for an elastomer-insulated switch using a controlled atmosphere contact assembly, which would be suitable for underground power distribution systems and other, similar applications. Switches for use in such applications must meet several demanding requirements. Those parts of the switch assembly connected to line voltage during use, including the contact assembly and operating rod, must be encased in a solid insulating housing having dielectric strength sufficient to withstand the maximum voltage which may be imposed on the system, which may be tens of thousands of volts for a distribution-level system. For safety, the insulating housing should be covered with a conductive layer that can be grounded. The switch should be operable from outside of the dielectric housing, without opening the housing. It should be capable of withstanding many years of exposure to temperature extremes, water and environmental contaminants. The switch must also survive continued exposure to high voltages. The switch should withstand repeated operation. To minimize arcing during switch opening and closing, the switch should include a mechanism to move the contacts rapidly, while also limiting the forces applied to the contacts and to the bottle as the contacts open and close. The switch should also be manufacturable at reasonable cost.

U.S. Pat. No. 3,471,669 seeks to provide such a switch for underground applications. The switch according to the '669 patent includes a sub-atmospheric or vacuum type controlled atmosphere contact assembly. The contact assembly for the coacting contacts has spaced reinforcing rods about the exterior and is directly encapsulated in a generally waterproof elastic jacket made of a "suitable synthetic resin substance such as one of the elastomers, silicone rubber or epoxy rubber", covered by an electrically conductive coating for grounding. A snap acting toggle assembly is disposed inside the jacket and linked to the operating rod of contact assembly. A rotatable shaft of dielectric material extends from the exterior of the jacket to the toggle assembly. Rotation of the shaft actuates the toggle to move the contacts and close or open the circuit.

However, the switch described in the '669 patent has not been widely adopted in the art. As reported in Odom et al, Development and Testing of Encapsulated Vacuum Sectionalizing Switch for Underground Distribution (IEEE publication, date unknown), elastomers which are vulcanized under heat and pressure cannot be used readily to the form the housing in the switch design and manufacturing process as shown in the '669 patent. The pressures encountered in molding such elastomers cause breakage of the bottles incorporated in the contact assemblies. The elastomer tends to penetrate into the mechanism, and to cause other problems.

Certain elastomers vulcanized by heat and pressure are especially useful insulating materials for underground electrical power systems. Elastomers such as EPDM (ethylene propylene diene monomer) combine high dielectric strength with excellent resistance to the effects of ozone and corona discharge. These elastomers can also provide good physical properties such as abrasion resistance, and can be molded at reasonable cost. Additionally, these elastomers can be compounded with conductive additives and molded to provide an electrically conductive grounding layer integral with the dielectric housing. For these and other reasons, elastomers molded and vulcanized under heat and pressure, such as EPDM, have been almost universally adopted as materials of construction for the housings used in other underground electrical distribution systems. The inability to use elastomers vulcanized under heat and pressure represents a serious shortcoming of the switches and methods disclosed in the '669 patent and Odom et al. article.

Additionally, the rotatable shaft extending through the jacket of the devices shown in the Odom et al. article and '669 patent poses serious reliability problems. Such a movable interface is susceptible to contamination and dielectric failure.

Perhaps for the foregoing reasons, the switches and methods disclosed in the '669 patent and Odom et al. article have not been widely adopted in the industry despite the long-felt need. Indeed, despite the long-felt need for a suitable polymer-insulated switch for underground high voltage systems, no truly satisfactory answer has been found heretofore.

SUMMARY OF THE INVENTION

One aspect of the present invention provides an encapsulated switch for use in a high voltage circuit comprising a housing made from an elastomeric material; a hollow, preferably tubular dielectric reinforcing element disposed in the housing and in intimate contact with the elastomeric material of the housing and a contact supporting assembly including a supporting bottle, such as a ceramic or glass bottle having contacts therein and having a controlled atmosphere therein disposed in and in spaced relation to the hollow reinforcing element. The switch according to this aspect of the invention most preferably includes a filler material different from the elastomeric material of the housing. The filler material substantially fills the space between said supporting bottle and said hollow reinforcing element. The contact assembly preferably includes a fixed contact and a coacting movable contact mounted in said supporting bottle, the movable contact being movable relative to said fixed contact. The switch further includes actuating means exterior of said contact assembly for operating said movable contact, and may also include first and second terminals electrically connected to the contacts.

The reinforcing element and the filler material effectively isolate the fragile contact assembly from the conditions encountered in molding the housing, while still providing a void-free dielectric structure. In preferred processes according to further aspects of the invention, discussed below may be molded in place in the housing, or press-fit into the housing. The contact assembly is placed into the reinforcing element, and the filler material is applied to fill spaces between the reinforcing element and housing. Because the contact assembly is never exposed to the elastomer of the housing during molding, the forces and pressures exerted during molding of this material cannot break the contact assembly. The material of the housing can be selected to provide the properties required in the structure, such as mechanical robustness, resistance to ozone and chemical attack, dielectric strength and reasonable cost. Because the filler is protected from external forces and chemical attack, it can be selected to facilitate placement around the contact assembly.

The elastomeric material of the housing preferably includes a dielectric rubber material vulcanized under heat and pressure such as a material including EPDM or consisting essentially of EPDM. The filler material may be selected from the group consisting of room temperature vulcanizing elastomers, greases, gels, and unvulcanized elastomeric materials.

The contact assembly typically has operating and fixed ends defining opening and closing endwise direction, said operating element and said operating contact being movable in said closing endwise direction to close the contacts. The switch may further include a fixed end buttress structurally connecting the fixed end of the contact assembly to the reinforcing element. The reinforcing element and buttress reinforce the bottle or bottle of the contact assembly against loads applied between said contacts upon closure thereof.

Preferably, the actuating means includes an actuating element accessible from the exterior of said housing and linked to said movable contact. Thus, the coacting contacts can be opened and closed by moving said actuating element. The housing most preferably includes a flexible diaphragm and the actuating element extends through said flexible diaphragm. The actuating element may be a dielectric rod fixedly connected to the center of the diaphragm. The periphery of the diaphragm may be formed integrally with the remainder of the housing or otherwise fixed in place relative to the housing. Thus, motion of the actuating element necessary to operate the switch may be accommodated by flexure of the diaphragm. There is no need for sliding or moving contact between elements of the housing and the actuating element. The diaphragm, and the fixed joint between the diaphragm and the actuating element, provide a reliable, durable seal with full voltage withstand capability.

The switch may further include a driver for forcibly moving the actuating element, and hence the movable contact, in the aforementioned opening and closing directions. Preferably, a spring is interposed between the driver and the movable contact of the contact assembly so that movement of the driver in the closing direction is transmitted to the movable contact through said spring. This helps to protect the contact assembly and housing from mechanical shock loads applied by the driver. The spring may be connected between the actuating element and the operating element of said contact assembly.

To further reinforce the housing against the closing loads applied by the driver, an exterior support element may overlie the housing. The exterior support element may be attached to the frame of the driver mechanism. Preferably, the elastomeric material of the housing engaged between the exterior support element and the reinforcing element.

Further aspects of the invention provide methods of making a switch. The methods desirably include the step of potting a contact assembly comprising an bottle and a pair of contacts disposed therein inside a hollow reinforcing element by providing a filler material between the bottle and reinforcing element so that the filler material fills gaps between the bottle and the reinforcing element. The method further includes the step of providing an elastomeric housing including a first elastomeric material different from said filler material around said reinforcing element in intimate contact therewith.

Preferably, the step of providing the elastomeric housing around said reinforcing element is performed prior to said potting step, and includes the step of molding an elastomer around said reinforcing element and vulcanizing said elastomer under heat and pressure. Alternatively, the step of providing the elastomeric housing may include the steps of molding an elastomer to form said housing and then press fitting reinforcing element into the housing either before or after the potting step.

Other objects and advantages of this invention will be better understood by those skilled in the art with reference to the accompanying drawings taken with the description which follows and in which:

DETAILED DESCRIPTION OF THE PREFERRED EMBODIMENTS

Figure 1:
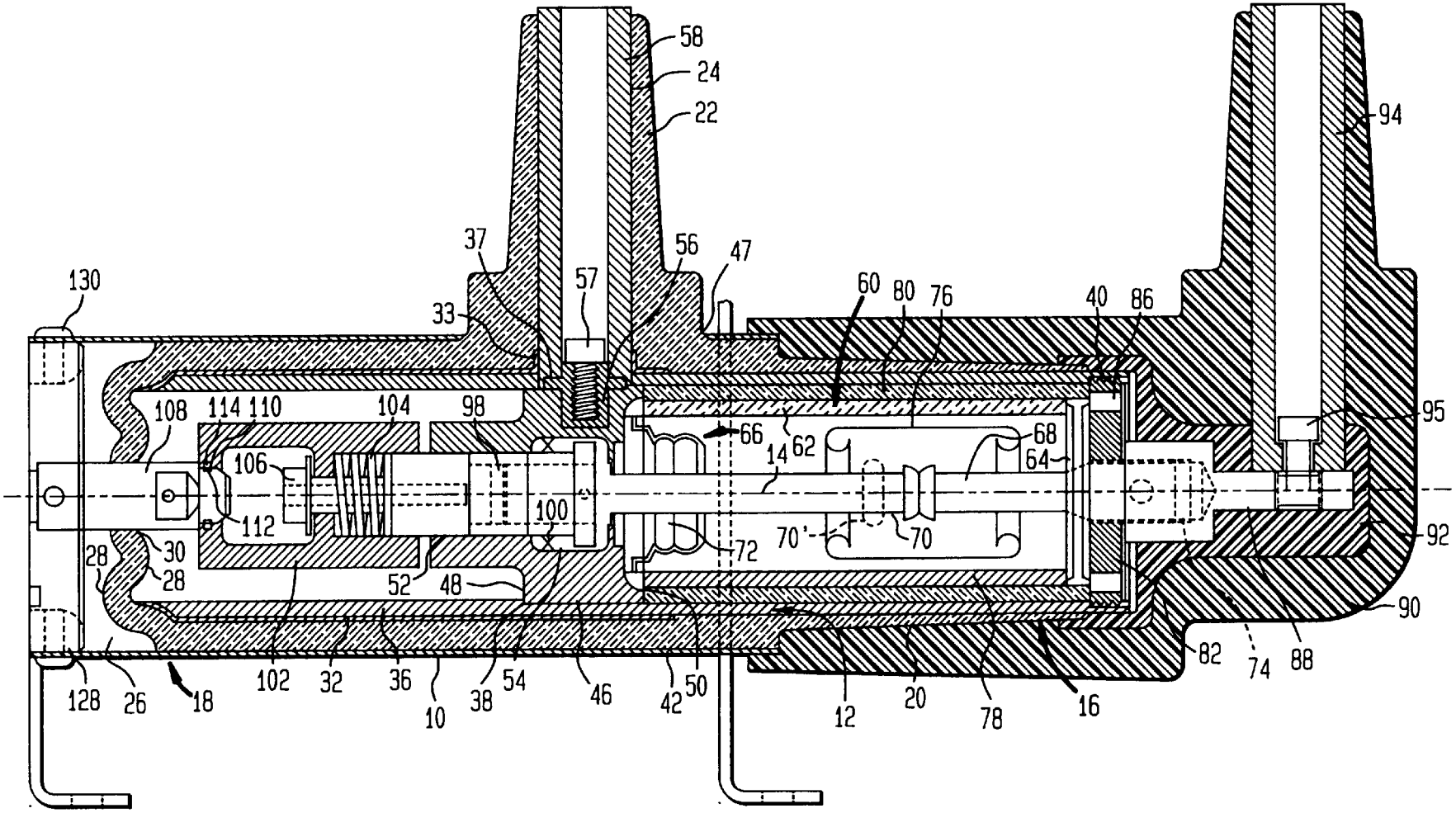
FIG. 1 is a fragmentary sectional view depicting a portion of a switch in accordance with one embodiment of the Invention.

A switch in accordance with one embodiment of the invention is a high-voltage switch. As used in this disclosure with reference to apparatus, the term "high voltage" means apparatus which is adapted to operate at a nominal system voltage above 3 kv. Thus, the term "high voltage" includes equipment suitable for use in electric utility service, such as in systems operating at nominal voltages of about 3 kv to about 38 kv, commonly referred to as "distribution" systems, as well as equipment for use in "transmission" systems, operating at nominal voltages above about 38 kv. The switch includes a housing 10 formed from a dielectric elastomer which is vulcanized under heat and pressure, such as ethylene propylene diene monomer (EPDM) elastomer. The housing defines an elongated bore 12 extending in endwise directions parallel to an axis 14. The housing has a fixed end 16 and a second, opposite end 18, referred to herein as the operating end. For reasons discussed below, the direction parallel to axis 14 along fixed end 16 is referred to herein as the closing endwise direction, whereas the opposite endwise direction, towards operating end 18 is referred to as the opening endwise direction. The housing defines a tapered bushing 20 at the fixed end and a further tapered bushing 22 extending perpendicular to the endwise axis. Bushing 22 has a tubular metallic current -carrying element extending through bushing 22 to bore 12 in a direction perpendicular to axis 14. The portion of housing 10 disposed between tapered bushing 20 and operating end 18 has a generally cylindrical exterior surface, so that the wall of the housing in this region is generally in the form of a cylindrical tube.

Housing 10 further includes a diaphragm 26 formed integrally with the other portions of the housing. Diaphragm 26 has a peripheral portion joining the tubular wall of the housing, a central portion 30 adjacent the axis 14 of the housing and annular convolutions 28 between the peripheral and central portions. Thus, although the peripheral portion of the diaphragm is fixed to the housing wall, the central portion 30 is free to move relative to the remainder of the housing upon flexure of convolutions 28.

Diaphragm 26 is thick enough to provide full voltage withstand capability. That is, the thickness of diaphragm 26 is selected so that the diaphragm will withstand the maximum voltage to be imposed between the current-carrying elements of the switch and ground during service or during fault conditions. For example, in a switch designed to operate at a nominal 25 KV phase-to-phase the diaphragm and other parts intended to provide full voltage withstand capability should be capable of withstanding at least about 14.4 KV continuously.

The housing is provided with an electrically conductive insert 32 formed from a mixture of the same elastomer used for the remainder of the housing and an electrically conductive material such as carbon black. Insert 32 covers the interior wall of bore 12 from diaphragm 26 to a point beyond bore 24. Insert 32 further extend radially inwardly for a short distance along the interior surface of diaphragm 26. The insert also has a short tubular section 33 extending along the exterior of the current-carrying element 58.

A rigid, tubular reinforcing element 36 extends substantially the entire length of housing 10 and bore 12. Reinforcing element 36 is formed from a dielectric material having high physical strength such as fiber reinforced thermosetting polymers, fiber reinforced thermoplastic polymers, and high strength polymers. Among the materials which can be used are fiberglass reinforced epoxy; polyamides; polyvinyl chloride and ultra high molecular weight polyethylene. The reinforcing element is provided with an annular shoulder 38 facing towards fixed end 16. Shoulder 38 faces in the closing endwise direction towards fixed end 16. Reinforcing element 36 protrudes slightly beyond the tip of conical portion 20 at the fixed end 16. The reinforcing element is provided with internal threads 40 at the fixed end of the device. The reinforcing element has a hole 37 aligned with the bore 24 of bushing 22.

A tubular exterior support element 42 closely overlies the exterior surface of housing 10 in the regions of the housing adjacent the operating end 10. The exterior support further extends in the opening endwise direction beyond the operating end 18 of the housing. Exterior support element 42 is formed from a rigid, electrically conductive material such as stainless steel or another metal. Bushing 22 extends from the housing through a hole 47 in the exterior support.

Exterior support 42 is in intimate, void-free contact with the outside of housing 10, and is securely bonded to the dielectric elastomer of the housing. Likewise, the semiconducting lining 32 is intimately bonded to the dielectric elastomer. Reinforcing element 36 is in intimate, void-free contact with insert 32 over one portion of its length, adjacent operating end 18 and with the dielectric elastomer of the housing over the remainder of its length.

These components are fabricated by insert molding. Thus, reinforcing element 36 is placed on an internal mandrel commonly referred to as a core. The core and reinforcing element are disposed within a mold cavity. The core has a face with grooves corresponding to convolutions 28. A further core extends through hole 37 in the reinforcing element. A mixture of elastomer and carbon is injected into the mold around the reinforcing element and cores and cured under heat and pressure to form the insert. The assembly is then transferred to different mold having the shape of the housing 10. The exterior support element is also disposed within the mold, so that the insert, reinforcing element and core contained therein are disposed within the exterior support element. Current-carrying element 58 is also positioned in the mold. The dielectric elastomer is then injected into the mold around the reinforcing element and insert, and within the exterior support element 42. The elastomer is maintained under heat and pressure by using the conditions normally employed for localization of EPDM. To promote bonding, the interior surface of exterior support element 42, and the outer surface of reinforcing element 36 may be treated with conventional adhesion promoting agents. The molding process forms a permanent, void-free assemblage of the support element, insert, dielectric elastomer housing and exterior support element. The sub-assembly is then assembled with the other components discussed below.

The switch further includes an operating end buttress 46. The operating end buttress is formed from a metallic, electrically conductive material, preferably copper or a copper alloy. The operating end buttress has a first face 48 facing towards the operating end of the device and engaged with the shoulder 38 of the reinforcing element. The operating end buttress also has a second face 50 facing towards fixed end 16. A bore 52 extends through the operating end buttress and is substantially coaxial with axis 14 of the housing and reinforcing element. Bore 52 has an enlarged section 54. The operating end buttress also has a threaded fitting 56. A bolt 57 is disposed within current carrying element 58 and engages the threaded fitting 56. As further discussed below, the operating end buttress serves as a terminal for passage of current through the switch. The bolt 57 serves to maintain electrical continuity between the current carrying element 58 and buttress 46.

A contact assembly 60 is disposed between the operating end buttress 46 and the fixed end 16 of the device. Contact assembly 60 includes a tubular ceramic bottle 62 with a metallic fixed end closure 64 disposed at one end of the bottle and a further, operating end closure 66 disposed at the opposite, operating end of the bottle. Operating end closure 66 includes a flexible, extensible metallic bellows. A fixed contact 68 is mounted to the fixed end closure 64 and projects into bottle 62, whereas a moveable or operating-end contact 70 is mounted to the bellows of the operating end closure 66. The assembly further includes a rod-like operating element 72 disposed on the outside of bellows 66 which forms an extension of the moveable contact. Likewise, a threaded fixed end stub contact 74 is formed integrally with the fixed end contact 68 and projects outwardly beyond the fixed end closure 64. The contact assembly 60 further includes a metallic shield 76 surrounding portions of the contacts, the shield being supported within the housing by a metallic frame 78 extending through bottle 62. For this purpose, bottle 62 may be formed in sections, and both sections may be joined to the metallic frame. Bottle 62 is hermetically sealed. Thus, the joint between the end closures, contacts and bottle are gas-tight.

The interior space within bottle 62, surrounding the contacts has a controlled atmosphere therein. As used in this disclosure, the term "controlled atmosphere" means an atmosphere other than air at normal atmospheric pressure. Most preferably, the atmosphere within bottle 62 is under a subatmospheric pressure. The composition of the atmosphere may also differ from normal air. Arc-suppressing gases such as $SF_6$ may be present within the bottle. The entire contact assembly 60 may be a conventional, controlled-atmosphere contact assembly of the type commercially available from numerous sources. One such contact assembly is available under the designation WL-35590 from the Cutler-Hammer Company of Horseheads, New York.

The exterior diameter of bottle 62 is slightly less than the interior diameter of reinforcing element 36, so that there is an annular space between the outside of the bottle and the inside of the reinforcing element. This annular space is completely filled with a dielectric filler material 80, so as to provide a substantially void-free interface between the outside of the bottle and the inside of the reinforcing element. Filler 80 is formed from a dielectric material different from the dielectric material of housing 10. Most preferably, the dielectric filler 80 is a material which can be placed and brought to its final form without application of extreme temperatures or pressures. In service, the dielectric filler is not exposed to substantial mechanical stress. Therefore, the filler can be selected substantially without regard for its ability to withstand mechanical stress, abrasion and the like. The filler should have good dielectric strength. Preferred fillers include greases such as petroleum-based and silicone-based greases, gels such as silicone gels and curable elastomers of the type commonly referred to as room-temperature vulcanizing or "RTV" elastomers. Compatibility between the filler and the rubber of housing 10 should also be considered. Petroleum-based materials tend to swell EPDM. Therefore, if a petroleum-based filler is employed with an EPDM housing, the filler should be isolated from the housing during service. The dielectric reinforcing element can provide such isolation. Similarly, a silicone-based filler would tend to swell silicone rubber. The filler can also be made by deliberately swelling a rubber or other polymer. Thus, the space between the outside of bottle 62 and the inside of reinforcing element 36 can be loosely packed with a swellable polymer, such as EPDM or silicone rubber. The loose packing may be provided as a solid tube or mass; as granules or pellets; or in any other form such as a foam or sponge. A liquid capable of swelling the particular polymer used, such as mineral oil (petroleum oil) in the case of EPDM or silicone oil in the case of silicone rubber, is then introduced into the space. The liquid causes the polymer to swell and fill the entire space, thereby providing a void-free interface. This technique can be applied to voids in other electrical assemblies as well.

A metallic fixed end buttress 82 is engaged with the threads 40 of reinforcing element 36 and engaged with the fixed end closure 64 of the contact assembly. The fixed end buttress has a central bore receiving stub contact 74. Additional holes 86 are also provided in the fixed end buttress for use during the assembly process as described below. The fixed end buttress forces bottle 62 in the opening direction, towards the operating end 18, and holds the operating end of the bottle, as well as the periphery of operating end closure 66 in firm engagement with the second face 50 of the fixed end buttress 46. Thus, the bottle 62 is maintained under compression. A metallic second terminal 88 is attached to stub terminal 74 and hence to the fixed end 68 of the contact. The switch further includes a fixed end cover 90 formed from a dielectric elastomer and a fixed end electrical stress relief element 92 formed from a semiconducting elastomer. The fixed end cover 90 is positioned on housing 10 so that an internal taper in the fixed end cover is firmly engaged with conical seat 20 at the fixed end of the housing and so that the fixed end electrical stress release element surrounds second terminal 88, stub terminal 74, fixed end buttress 82 and the fixed end closure 64 of the contact assembly. The fixed end cap has a second tubular metallic current carrying element 94 mounted therein. A bolt 95 disposed in the current-carrying element is threadedly engaged with the second terminal 88.

A link 98 is slidably received in bore 52 of the operating end buttress 46. Link 98 is threadedly engaged with the operating element 72 of the contact assembly, and the threaded connection is locked against movement during service, as by a pin (not shown) extending through the threadedly engaged elements. An annular contact 100, of the type commonly referred to as a "louvered" contact, encircles link 98. Contact 100 has projections on its interior and exterior surfaces. The flexible projections on contact 100 bear on buttress 46 and on the link, thereby establishing a slidable electrical connection between the buttress and the link. Thus, the moveable contact 70 of the contact assembly is electrically connected to the first terminal or buttress 46. Alternatively, a flexible metallic strap, such as a braided copper strap, can be connected between link 98 and the first end buttress or first terminal 46. A yoke 102 is slidably engaged with link 98. A coil compression spring 104 is disposed between yoke 102 and the end of link 98, so that motion of the yoke in the closing direction, towards fixed end 16, to the right in FIG. 1, will be transmitted to link 98 and hence to moveable contact 70 by a spring. A bolt 106 is engaged with the link and the yoke so that motion of the yoke in the opposite, opening direction (to the length in FIG. 1) will be transmitted to link 98 and to the moveable contact 70 through bolt 106. Bolt 106 desirably applies a preload to spring 104, so that the spring remains in compression at all times.

An actuating element 108 formed from a strong, rigid dielectric material such as epoxy-reinforced fiberglass extends through diaphragm 26 at the center 30 thereof. Actuating element 108 is fixedly attached and bonded to the center of diaphragm 30. Preferably, actuating element 108 may be insert-molded into the diaphragm, by positioning the actuating element in the mold when the diaphragm is formed, during the aforementioned insert-molding process with a chemical bonding agent on the actuating element surface. Chemical bonding agents are well-known in the art of rubber molding. One suitable chemical bonding agent is sold under the registered trademark Chemlok 205. The actuating element itself, and the joint between the actuating element and the diaphragm should each have full voltage withstand capabilities.

Figure 8:
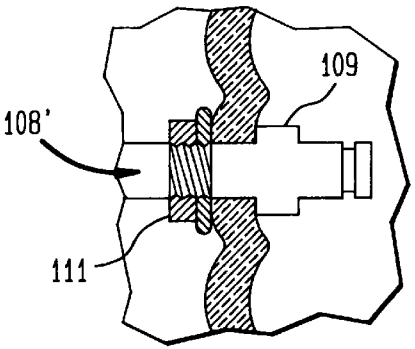
FIG. 8 is a further fragmentary sectional view depicting parts of a switch according to another embodiment of the invention.

Alternatively, as shown in FIG. 8, the actuating element may be assembled to the diaphragm. This may be accomplished by molding the diaphragm with a hole smaller than the diameter of the actuating element, and then press-fitting the actuating element into the hole so as to form an intimate bond between the surface of the actuating element and the surrounding portions of the diaphragm. The actuating element may be provided with a shoulder 109 on one side of the diaphragm and a fastener 111 such as a nut and washer on the other side of the diaphragm. The fastener and the shoulder hold the central portion of the diaphragm in compression and hold the actuating element in fixed position relative to the diaphragm. Such a compression joint establishes a fixed, secure interface between the actuating element and the diaphragm. Still further details and alternative embodiments of the diaphragm are set forth in my copending, commonly assigned United States Patent Application entitled A Diaphragm Seal For a High Voltage Switch Environment, filed of even date herewith, the disclosure of which is hereby incorporated by reference herein.

Actuating element 108 is connected to yoke 102 by a snap-engageable connection. Thus, yoke 102 has a hole in the end of the yoke closest to the operating end of the device, and a groove 110 in the wall of such hole. Actuating element 108 has a circumferential groove 112 extending around it. A resilient snap ring 114 is engaged in these grooves so as to connect the actuating element to the link for movement therewith in endwise directions.

In the preferred assembly process according to the invention, the molded subassembly including housing 10, reinforcing element 36, line 32 and external support element 42 is made by molding in the manner discussed above. Actuating element 108 is assembled to the diaphragm. The contact assembly 60, first end buttress 46, link 98 and yoke 102 are connected with one another to form a subassembly. This subassembly also includes the other components connected between the elements, such as yoke 106, spring 104 and flexible connector 100. Snap ring 114 is positioned in the groove 110 of the yoke. This subassembly is then slidably inserted through the open end of the reinforcing element at the fixed end 16 of the device. The subassembly is slidably moved within the bore of the reinforcing element, while the actuating element 108 is held in position by a fixture (not shown) disposed outside of the housing. When yoke 102 reaches the tip of actuating element 108, the actuating element enters the hole in the yoke and snap ring 114 engages in slot 112, as well as in slot 110. The first face 48 of buttress 46 engages the ridge 38 of the reinforcing element. The bolt 57 in the current-carrying element is engaged in threaded hole 56 and tightened.

Filler material 80 is injected around the outside of the bottle 62 of the contact assembly 60. Fixed end buttress 82 is threaded into engagement with the reinforcing element 36, thus forcing the operating end of the bottle, and the peripheral portion of operating end closure 66 into firm engagement with the second face 50 of the first end buttress. This firm engagement provides a seal around the periphery of the first end buttress, which in turn prevents flow of the filler material 80 into the bore 52 of the first end buttress and into the spaces surrounding link 98 and yoke 102. At the same time, the first end buttress tends to compress the filler material 80 in the space between the bottle and reinforcing element. Excess filler is allowed to escape through holes 86 in the fixed end buttress, and is removed manually. Where the filler is a curable material, it can be cured to form a solid or semisolid.

The fixed end cap 90 and second terminal 88 are assembled to the other elements. The current carrying element 94 is connected to terminal 88 by tightening bolt 95. A driver assembly 120 is attached to the other elements of the switch. Driver assembly 120 includes a driver frame 122 mounted to the housing 10 of the switch; a mobile element 124 connected to the actuating element 108 and a mechanism 126 for moving the mobile element in the opening and closing directions to move the actuating element and thereby move the mobile contact 70 (FIG. 1), thus opening and closing the switch.

Figure 2:
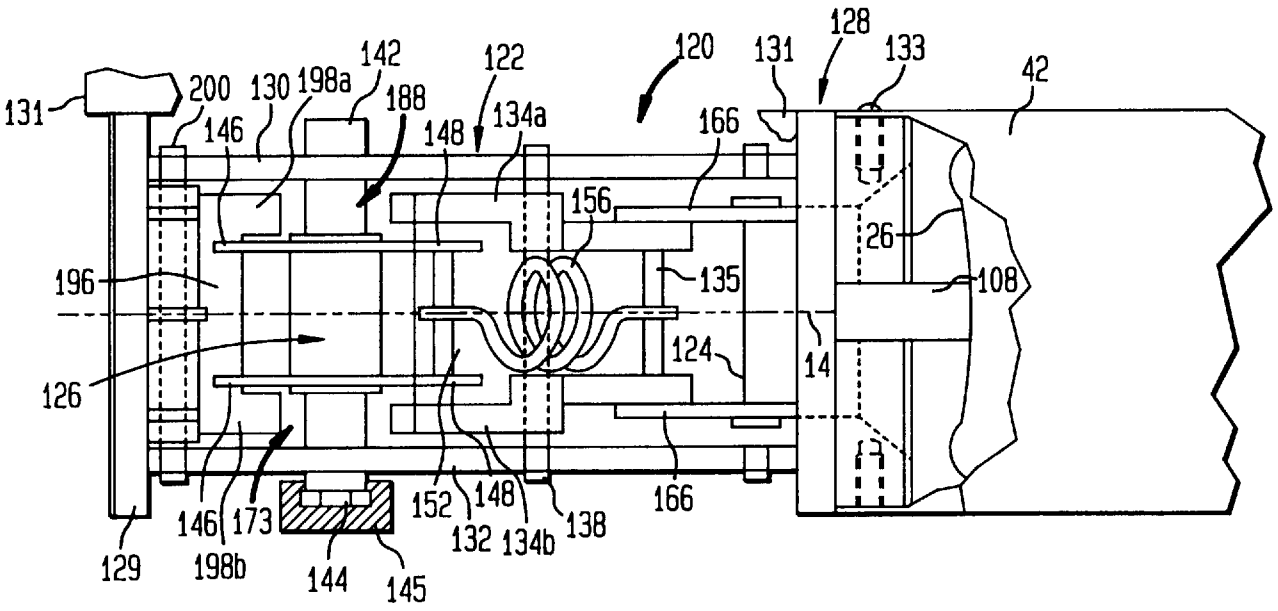
FIG. 2 is a fragmentary diagrammatic plan view depicting another portion of the mechanism shown in FIG. 1 with parts removed for clarity of illustration.

Driver frame 120 may be formed from stainless steel or other suitable corrosion resistant metal or other material. The driver frame has an annular collar 128 formed at a forward end and a further collar 129. Collar 128 is sized so that it fits within the tubular external support element 42 (FIG.1). Machine screws 133 hold the collar 128 and hence driver frame 122 in assembled position relative to the external support element and thus relative to the elastomeric housing 10. A further cylindrical housing 131 (FIG. 2) fits over collar 129 and covers the mechanism of the driver. Only small portions of housing 131 are depicted in FIG. 2; the remainder is removed for clarity of illustration. Further, cover 131 is omitted in FIGS. 3–6.

The driver frame 122 and collar 128 are disposed adjacent the operating end 18 of housing 10. The outer end of actuating element 108 extends though the collar assembly 128 into the driver frame 122, where the actuating element is connected to the mobile element 124 of the driver assembly by an adjustable connection such as a threaded connection, provided with a pin or other suitable locking device for locking the adjustment.

Driver frame 122 includes a pair of plates 130 and 132 (FIG. 2). A pair of bellcrank elements 134*a* and 134*b* are mounted on a bellcrank shaft 138 extending between the plates. Bellcrank elements 134 are rigidly connected to one another by a plate 139 extending therebetween. An opening side pin 135 and a closing side pin 137 extend between the bellcrank elements 134 adjacent the forward end of the mechanism on opposite sides. As best seen in FIGS. 3–6, each bellcrank element has a generally arcuate surface with a notch 140 therein.

Figure 3:
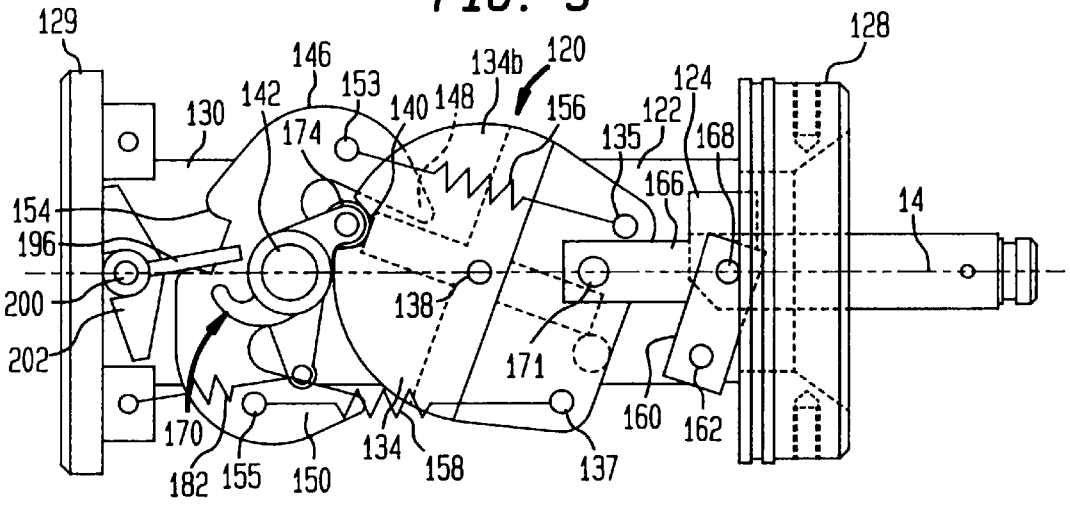
FIG. 3 is a diagrammatic elevational view of the portion illustrated in FIG. 2.

An operating shaft 142 extends through plates 130 and 132 in bearings (not shown), so that the operating shaft is rotatable with respect to the driver frame. Operating shaft 142 has a polygonal head 144 on one end for engagement by an operating handle 145. A pair of cam plates 146 are fixedly mounted to operating shaft 142. Each cam plate has a pair of main projections 148 and 150 (FIG. 4)extending in the forward direction, toward collar 128 and a pair of catch surfaces 152 and 154 (FIGS. 3 and 4) extending in the rearward direction. As best seen in FIGS. 2 and 3, the opening side projections 148 of cam plates 146 extend between bellcrank elements 134 when the mechanism is in the closed position illustrated in FIGS. 2 and 3. Closing side projections 150 similarly extend between the bellcrank elements when the mechanism is in the open position illustrated in FIG. 5. An opening side pin 153 extends between cam plates 146, adjacent the opening side projections thereof. A closing side pin 155 extends between the cam plates adjacent the closing side projection 150.

An opening side main spring 156 extends between the opening side pin 135 of the bellcranks and opening side pin 153 of cam 146. As best seen in FIG. 2, opening side spring 156 is a large, powerful spring which substantially occupies the space between the bellcrank elements and the space between the projections of the cam plates. A similar closing side spring 158 extends between the closing side pin 154 of cam 146 and the closing side pin 137 of the bellcrank. Although closing spring 158 is depicted only schematically in FIGS. 3–6, it should be appreciated that the closing side spring is also a massive, powerful spring which occupies much of the space between the bellcrank elements and between the closing side projections 150 of the cam plates.

Figure 4:
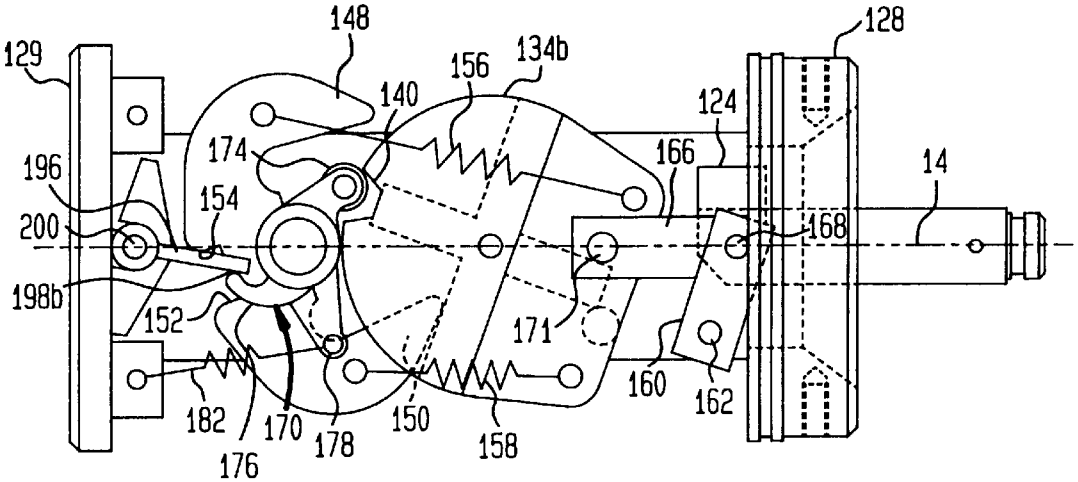
FIG. 4 through 6 are views similar to FIG. 3 but depicting the mechanism in different operating positions.

A pair of guide link plates 160 are pivotally mounted to the driver frame adjacent plates 130 and 132 on pins 162 (FIGS. 3 and 4). A pair of drive link plates 166 extend adjacent frame plates 130 and 132. A main pin 168 connects the guide link plates 162 to the drive link plates 166, and also connects the link plates to the mobile element 124 of the drive mechanism. Drive link plates 166 are connected by further pins 171 to the bellcrank elements. The driver frame 122, guide links 162, drive links 166 and bellcrank elements 134 constitute a mechanism of the type commonly referred to as a "four bar" linkage.

An opening catch 170 (FIGS. 3 and 4) is rotatably mounted on operating shaft 142. Opening catch 170 is disposed in a space 173 adjacent cam plate 146, on one side of the mechanism. Catch 172 is omitted for clarity of illustration in FIG. 2 and in FIGS. 5 and 6. Opening catch 170 has a collar-equipped tip 174. The opening catch 170 also has a finger 176 and a spring mount 178. A catch spring 182 is engaged between the spring mount 178 and the cap 129 of the driver frame. Spring 182 biases opening catch 170 in the clockwise direction as seen in FIGS. 3 and 4, and thus biases the tip 174 of the catch into engagement with the arcuate surface of bellcrank element 134*b*.

A similar closing catch 186 (FIGS. 5 and 6) is rotatably mounted to the operating shaft 142 in space 188 (FIG. 2) adjacent bellcrank element 134*a*. Closing catch 186 is omitted for clarity of illustration in FIG. 2 and FIGS. 3 and 4. Closing catch 186 has a roller equipped tip 190, spring arm 192 and finger 194 similar to the corresponding elements of the opening catch. Catch spring 197 is engaged between spring arm 192 of the closing catch and cap 129 of the frame so as to bias the closing catch in the counterclockwise direction about shaft 142 and thus bias the tip 190 into engagement with bellcrank plate 134*a*. A flipper plate 196 having a pair of projections 198*a* and 198*b* (FIG. 2) is pivotally mounted to the driver frame on an intermediate shaft 200 extending between the frame plate 130 and 132. Pivoting movement of the plate is limited by stops 202 (FIGS. 3–6). All of the shafts 200, 142 and 138 are parallel to one another and coplanar with one another. All of the shafts perpendicularly intersect axis 14 of the switch. Further details of the driver or actuator mechanism are set forth in the copending, commonly assigned United States Patent Application of Lloyd B. Smith entitled Switch Actuator filed of even date herewith, the disclosure of which is hereby incorporated by reference herein.

In operation, the switch is connected in the circuit through current-carrying elements 58 and 94, and hence through terminals 46 and 88. Insert 32 is electrically connected to the first terminal 46. Thus, the insert is maintained at the same electrical potential as the first terminal or buttress 46. Link 98 and yoke 102 are at the same potential, and hence there is no potential gradient within the space enclosed by insert 32. Stress relief element 92 likewise maintains all of the components at the fixed end of the switch at the potential of second terminal 88.

In the position illustrated in FIGS. 1–3, the switch is closed. Pin 171 is disposed on axis 14 in alignment with the bellcrank shaft 138 and pin 168. The tip of 174 of the opening catch is engaged in the slot 140 of bellcrank element 134*b*. To open the switch, the lineman engages handle 145 (FIG. 2) and turns the handle so as to turn cam plates 146 counterclockwise as seen in FIGS. 3 and 4. As the lineman turns the cam plates, opening spring 156 is stretched between pins 153 and 135, whereas closing spring 158 is relaxed. With continued motion of the cam, the mechanism reaches the position illustrated in FIG. 4. In this position, the closing side projections 150 of the cam plates are engaged between the bellcrank elements 134. Thus, the cam plates and the bellcrank elements form a substantially continuous channel, with walls bounding the closing spring 158 on opposite sides thereof.

As the cam plates are moved from the position of FIG. 3 to the flipper position of FIG. 4, surface 154 on the cam plate engages flipper plate 196, and turns it in the clockwise direction about shaft 200. A projection on plate 196 engages the finger 176 of the opening catch, thereby forcing the opening catch in the counterclockwise direction against the bias of spring 182. The roller tip 174 of the catch is lifted out of slot 140 in bellcrank element 134*b*. It should be appreciated that the catch surface 154 does not engage the flipper plate, and the flipper plate does not engage finger 176 until cams 146 are almost at the end of their counterclockwise rotary movement. The entire action of lifting the roller tip 174 out of slot 140 occurs over a very short rotational movement of cams 146.

Figure 5:
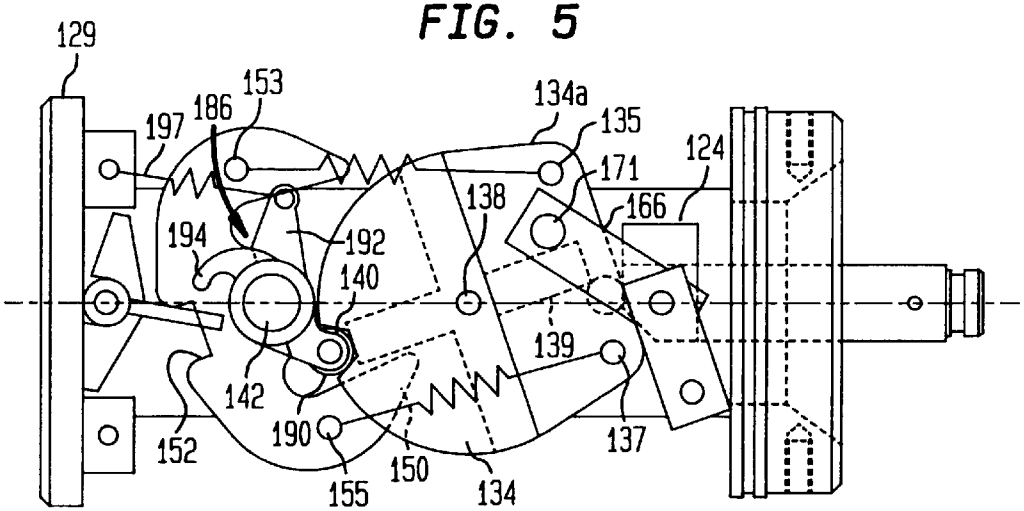
Figure 6:
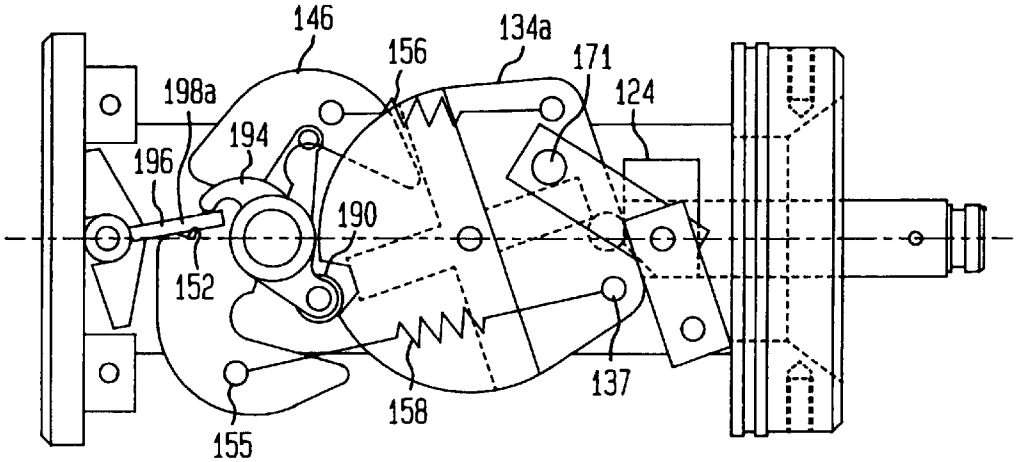
Figure 7:
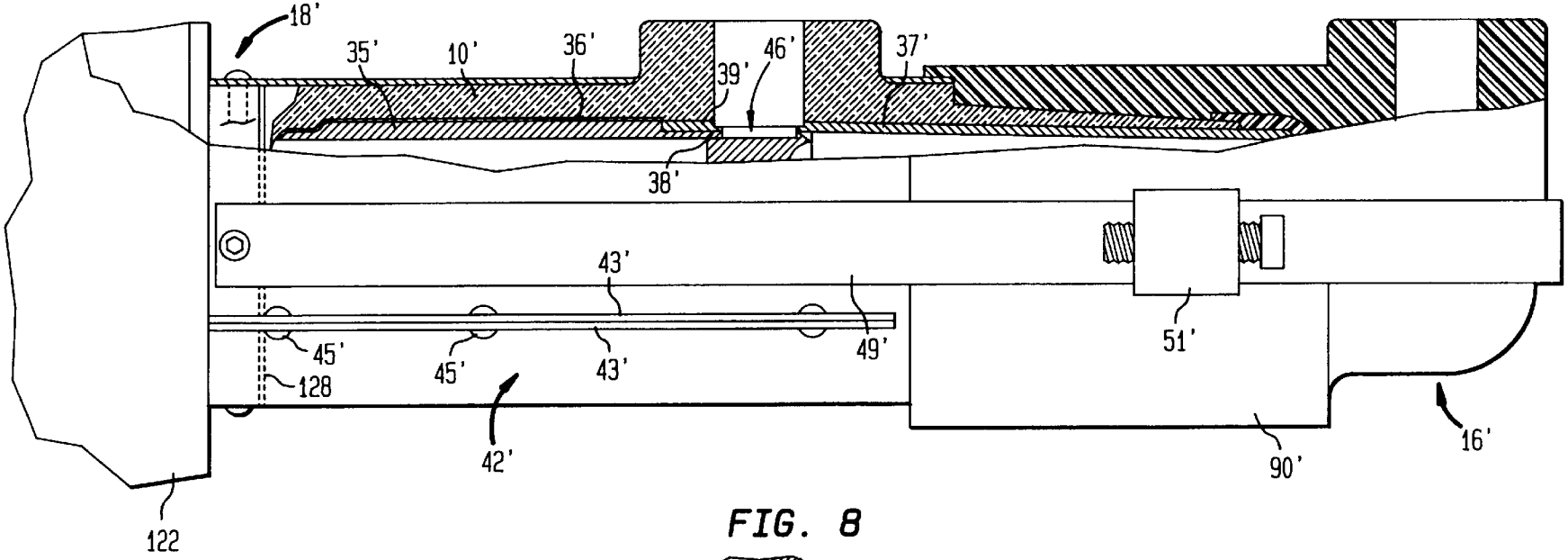
FIG. 7 is a fragmentary sectional view similar to FIG. 1 but depicting a switch in accordance with a further embodiment of the invention.

When the roller tip 174 clears slot 140, opening spring 156 drives the bellcrank elements 134 in rotation in a closing direction, counterclockwise as seen in FIGS. 3 and 4, until the bellcrank elements reach the position illustrated in FIG. 5. Pin 171 on the bellcrank pulls the drive links 166 with it and hence moves the mobile element 124 of the drive mechanism in the opening direction (to be left as seen in the drawings). Thus, the mobile element pulls the actuating element 108, yoke 102 (FIG. 1), bolt 106, link 98 and operating element 72 in the opening direction. Thus, the movable contact 70 is moved to its open position. This movement occurs suddenly, thereby minimizing any possibility of arcing between the contacts. As the bellcrank elements move to the position of FIG. 5, the tip 190 of the closing catch 186 engages in the slot 140 of bellcrank element 134*a*, under the influence of spring 197. This locks the mechanism in the open position illustrated in FIG. 5.

The closing action operates in a similar fashion, but with a reverse rotation. Thus, the lineman actuates the handle so as to turn the operating shaft and the cams 146 in the closing or clockwise direction allowing the opening spring 156 to relax and stretching closing spring 158. As the mechanism approaches the position of FIG. 6, catch surface 152 on the cams engages flipper plate 196, so that a projection 198*a* of the plate engages the finger 194 of the closing catch, thereby lifting the roller tip 190 out of engagement with slot 140 in bellcrank element 134*a*. This, in turn, allows the closing spring 158 to drive the bellcrank 134*a* in rotation in a closing direction, clockwise as seen in the drawings, until the bellcranks reach the closed position illustrated in FIG. 3. As the bellcranks turn to the closed position, it forces pin 171 and hence the drive link 166 and mobile element 124 in the closing direction, thus forcing all of the other elements of the switch and ultimately movable contact 70 in the closing direction, to the closed position depicted in FIG. 1.

The closing rotation of cam plate 146 is arrested by stops 202 and the flipper plate 196. The closing movement of the bellcrank elements 134 (from the position of FIG. 6 to the position of FIG. 3) brings pin 171 into alignment with pins 138 and 168. As pin 171 approaches this position, the linkage provides a substantial mechanical advantage so that the mobile element 124 is driven in the closing direction with substantial force. The connection between mobile element 124 and actuating element 108 is adjusted so that movable contact 70 engages fixed contact 68 slightly before closing movement of the driver mechanism is completed. The final motion of the driver mechanism, after contact engagement, is accommodated by sliding movement of yoke 102 (FIG. 1) relative to link 98, against the bias of spring 104. This movement minimizes mechanical shock loading applied to the contacts.

The loads which are applied to the contact assembly during closing motion are transmitted through fixed contact 68 fixed, end closure 64 and fixed end buttress 82 to reinforcing element 36 via threaded connection 40. Essentially none of these loads are applied to bottle 62. The loads applied to reinforcing element 36 tend to move it in the closing direction (to the right in FIG. 1) relative to the driver frame. However, exterior reinforcing element 42 is fixed to the driver frame by collar 128. The exterior reinforcing element restrains housing 10, which in turn restrains the reinforcing element. The interior and exterior reinforcing elements 36 and 42 are telescoped together, and engage housing 10 over large surface areas, with only a thin annular portion of the elastomer of the housing interposed between them. This forms a rigid, stress-resistant joint which firmly supports the reinforcing element 36 against motion.

The driver mechanism discussed above provides significant advantages. The driver mechanism discussed above moves the contact rapidly between opened and closed positions so as to minimize arcing. The driver mechanism is extremely compact. The entire mechanism is accommodated in a tubular housing of essentially the same diameter as the switch exterior reinforcing element. An O-ring or other conventional seals (not shown) can be provided between driver tubular housing 131, collars 128 and 129 and so as to provide a weather- tight seal protecting the elements of the driver mechanism. The driver housing 131 is also provided with a hole (not shown) for passage of the handle 145. This hole may be provided with appropriate seals.

Although the mechanism discussed above is particularly preferred, any of the other numerous drive mechanisms known in the art for moving switch contacts can be used in the switch according to the broad compass of the present invention. For example, pneumatically-operated devices, solenoid-actuated devices, spring-operated devices and other known mechanisms can be used. These can be either manually activated or automatically activated by a control system or by a sensor associated with the switch for detecting a condition in the circuit. For example, a switch in accordance with the present invention may be provided with a driver mechanism activated by a current sensor to thereby form a current-sensitive circuit breaker.

A switch in accordance with another embodiment of the invention includes an elastomeric, dielectric housing 10' and internal components similar to those discussed above. However, the internal, tubular reinforcing element 36' is formed in two pieces 35' and 37' joined with one another by mating threads 39' on the two pieces. The internal diameter of piece 35' adjacent the operating end 18' of the housing, is slightly smaller than the internal diameter of piece 37', so that piece 35' defines a ridge 38' facing toward the fixed end 16 of the housing. As in the embodiment discussed above, ridge 38' engages the first end buttress 46'. In an assembly process according to an embodiment of the invention, housing 10' is molded with an interior bore of diameter slightly smaller than the outer diameter of the reinforcing element. Reinforcing element 36' is then forcibly press-fit into the housing. The housing may be stretched, as by introducing compressed air into the bore, to facilitate this process. Also, external reinforcing element 42' is formed as a pair of semicylindrical sheet metal halves, with fastening flanges 43' on each half. The halves are assembled to housing 10' after reinforcing element 36' has been inserted. The halves are then secured to one another by bolts 45', rivets, clamps or other mechanical devices, thereby compressing the elastomer of housing 10' around the reinforcing element 36'. Suitable bonding agents may be applied to the housing and to the halves of the reinforcing elements.

The external reinforcing element 42' also includes a metallic strap 49' extending around the fixed end 16' of housing 10' and around the fixed end cap 90'. Strap 49' is fastened to the driver frame 122' by screws engaging ring 128', which in turn is connected to the driver frame. Strap 49' is provided with a screw mechanism 51' for tightening the strap. Once strap 49' has been tightened, it aids in holding the fixed end of the contact assembly in place, and helps to resist the closing loads applied by the driver through the contacts. In a further alternate embodiment, the tubular part of the metallic external reinforcing element 42' may be omitted, so that strap 49' provides the only external reinforcement. In this case, housing 10' desirably has a molded-on semiconductive exterior coating.

As will be appreciated, numerous variations and combinations of the features discussed above can be utilized without departing from the present invention as defined by the claims. For example, the threaded connection 40 (FIG. 1) between fixed end buttress 82 and the reinforcing element 36 can be replaced by a pinned joint. Also, the exterior support element may be formed as a set of rods extending from the driver frame toward the fixed end of the housing. Accordingly, the forgoing description of the preferred embodiment should be taken by way of illustration rather than by way of limitation of the invention.

What is claimed is:

1. An encapsulated high voltage switch for use in a high voltage distribution circuit comprising, a. a housing made from an elastomeric material, b. a hollow reinforcing element disposed in the housing and in intimate contact with the elastomeric material of the housing, c. a contact supporting assembly including a bottle having contacts therein and having a controlled atmosphere therein disposed in and in spaced relation to the hollow reinforcing element, and d. a filler material different from said elastomeric material substantially filling the space between said bottle and said hollow reinforcing element.

2. The encapsulated high voltage switch as in claim 1 wherein said contacts include a fixed contact and a coacting movable contact mounted in said bottle, said movable contact being movable relative to said fixed contact, the switch further including actuating means exterior of said sub-atmospheric contact supporting assembly for operating said movable contact.

3. The encapsulated high voltage switch as in claim 2 wherein said actuating means includes an actuating element accessible from the exterior of said housing and linked to said movable contact whereby said coacting contacts can be opened and closed by moving said actuating element.

4. The encapsulated high voltage switch of claim 3 wherein said housing has a flexible diaphragm and said actuating element extends through said flexible diaphragm.

5. The encapsulated high voltage switch as in claim 3 or claim 4 wherein said actuating means includes a lost motion connector connected between said actuating element and said movable contact.

6. A high voltage switch comprising:

(a) a contact assembly including a fixed contact and a movable contact disposed for operative coaction with said fixed contact, and a bottle surrounding the contacts and maintaining a controlled atmosphere around said contacts, said movable contact being movable within said bottle relative to said fixed contact, said assembly having an operating element accessible from outside of the bottle and connected to said movable contact for movement thereof relative the fixed contact;

(b) a hollow reinforcing element surrounding said bottle;

(c) a filler material disposed between said bottle and said reinforcing element and substantially filling any voids between said bottle and said reinforcing element;

(d) an elastomeric housing surrounding said reinforcing element in intimate contact therewith;

(e) first and second terminals connected to said contacts and accessible from the exterior of said housing; and (f) an actuating element accessible from the exterior of said housing and linked to said operating element of said assembly whereby said contacts can be opened and closed by moving said actuating element to thereby move operating element of said contact assembly and said movable contact.

7. A switch as claimed in claim 6 wherein said housing includes a layer of a first elastomeric material surrounding said reinforcing element, said first elastomeric material being of different composition than said filler material.

8. A switch as claimed in claim 7 wherein said first elastomeric material is a rubber material vulcanized under heat and pressure.

9. A switch as claimed in claim 7 wherein said first elastomeric material includes EPDM.

10. A switch as claimed in claim 9 wherein said first elastomeric material consists essentially of EPDM.

11. A switch as claimed in claim 7 wherein said first elastomeric material is a dielectric elastomer, the housing further including a layer of a second, semi-conducting elastomer at least partially surrounding first elastomeric material.

12. A switch as claimed in claim 7 wherein said filler material is selected from the group consisting of room temperature vulcanizing elastomers, greases, gels, and unvulcanized elastomeric materials.

13. A switch as claimed in claim 7 wherein said bottle has a wall formed from a ceramic material.

14. A switch as claimed in claim 7 wherein said contact assembly has operating and fixed ends defining a closing endwise direction towards said fixed contact and an opening endwise direction towards said operating end, said operating element and said operating contact being movable in said closing endwise direction to close the contacts, the assembly further comprising a fixed end buttress structurally connecting said fixed end of said contact assembly to said reinforcing element and reinforcing said bottle against loads applied between said contacts upon closure thereof.

15. A switch as claimed in claim 14 wherein said reinforcing element includes an elongated tube extending generally in said endwise direction and having operating and fixed ends disposed adjacent to the operating and fixed ends of the contact assembly, respectively.

16. A switch as claimed in claim 15 wherein said fixed end buttress is attached to said fixed end of said tube, the assembly further comprising an operating end buttress engaged with the tube and with the operating end of the bottle.

17. A switch as claimed in claim 16 wherein said operating end buttress is electrically conductive, said operating element of said contact assembly being electrically connected to said operating end buttress and movable with respect thereto.

18. A switch as claimed in claim 17 wherein said operating end buttress constitutes such first terminal.

19. A switch as claimed in claim 16 wherein said actuating element is movable in said opening and closing directions, the switch further comprising a spring interposed between said actuating element and said operating element of said contact assembly so that movement of said actuating element in said closing direction is transmitted to said operating element through said spring.

20. A switch as claimed in claim 19 further comprising a link slidably mounted to said operating end buttress for movement in said opening and closing directions, said link being connected to said operating element of said contact assembly and to said spring.

21. A switch as claimed in claim 14 wherein said actuating element is mounted to said housing for movement in said opening and closing directions, the switch further comprising a driver assembly having a driver frame, a mobile element and movement means for selectively impelling said mobile element in said opening and closing directions relative to said frame, said driver frame being connected to said housing, said mobile element being connected to said actuating element whereby said movement means can open and close said contacts.

22. A switch as claimed in claim 21 wherein said housing has an operating end and a fixed end, said operating and fixed ends of said contact assembly being disposed adjacent to said operating and fixed ends of said housing, respectively, and wherein said driver frame is disposed at the operating end of the housing, the switch further comprising an exterior support element extending from said driver frame towards said fixed end of said housing and fastened to said housing.

23. A switch as claimed in claim 22 wherein said exterior support element encloses at least a part of said driver assembly.

24. A switch as claimed in claim 22 wherein said reinforcing element has operating and fixed ends disposed adjacent said operating and fixed ends of the housing, said exterior support element overlapping said reinforcing element so that a portion of said elastomeric housing is disposed between said reinforcing element and said exterior support element.

25. A switch as claimed in claim 24 wherein said exterior support element and said reinforcing element are bonded to said housing.

26. A switch as claimed in claim 24 wherein said reinforcing element includes a tube and wherein said exterior support element includes a tube substantially concentric with said tube of said reinforcing element, said tubes being telescopically engaged so that said portion of said housing includes a tubular elastomeric layer.

27. A switch as claimed in claim 22 wherein said exterior support element extends from said driver frame around said fixed end of said housing.

28. A switch as claimed in claim 6 wherein said contact assembly has opposite opening and closing directions, said operating element being movable in said opening and closing directions, and wherein said elastomeric housing includes a flexible diaphragm having a periphery connected to the remainder of the housing and a central portion movable with respect to the periphery in said opening and closing directions, said actuating element being fixedly mounted to said central portion of said diaphragm and movable relative to said bottle in said opening and closing directions upon flexure of said diaphragm.

29. A switch as claimed in claim 6 wherein said controlled atmosphere maintained by said bottle is at sub-atmospheric pressure.

* * * * *